US007752819B2

(12) United States Patent
Zhu

(10) Patent No.: US 7,752,819 B2
(45) Date of Patent: Jul. 13, 2010

(54) ASSEMBLAGE CONCRETE SYSTEM AND METHODS OF CONSTRUCTING THEREOF

(76) Inventor: Qinjiang Zhu, No. 57, Long Island Villa, No. 3558, North Kunming Road, Minxing District, Shanghai (CN) 201111

( * ) Notice: Subject to any disclaimer, the term of this patent is extended or adjusted under 35 U.S.C. 154(b) by 854 days.

(21) Appl. No.: 11/550,154

(22) Filed: Oct. 17, 2006

(65) Prior Publication Data

US 2007/0107341 A1 May 17, 2007

(30) Foreign Application Priority Data

Oct. 17, 2005 (CN) ..... 2005 1 0200614

(51) Int. Cl.
*E04C 1/00* (2006.01)

(52) U.S. Cl. ..... 52/309.12; 52/309; 52/425; 52/426; 52/745.05

(58) Field of Classification Search ..... 52/309, 52/309.11, 309.12, 425, 426, 439, 745.05
See application file for complete search history.

(56) References Cited

U.S. PATENT DOCUMENTS 2,029,082 A * 1/1936 Odam ..... 52/275
3,788,020 A * 1/1974 Gregori ..... 52/309.12
4,698,947 A * 10/1987 McKay ..... 52/309.12
5,450,700 A * 9/1995 Hackman ..... 52/425
6,237,292 B1 * 5/2001 Hegemier et al. ..... 52/273
6,681,539 B2 * 1/2004 Yost et al. ..... 52/309.11

* cited by examiner

*Primary Examiner*—Basil Katcheves
(74) *Attorney, Agent, or Firm*—Matthias Scholl P.C.; Matthias Scholl

(57) ABSTRACT

This invention teaches inter alia a one-piece layered monolithic modulus of composite thermally-insulated concrete walls comprising a foundation; a concrete wall; a plurality of reinforcing steel plates; a pair of wall form panels; a slab; and optionally a plurality of slab-supporting bars; wherein the wall form panels having a plurality of steel plates distributed in uniform spacing and embedded vertically therein are made of polystyrene foam plastic; a plurality of teeth are vertically arranged on the two peripheral edges of the steel plate; a cavity is formed on each tooth; the teeth and the cavities protrude out of the inner surface of said wall form panels; a pair of channel-shaped steels with slots facing upwards are affixed horizontally on the foundation; the bottom surfaces of the wall form panels are affixed respectively into the slots of the channel-shaped steels; a plurality of welded steel fabrics are embedded in the spaces between the wall form panels; at least two wall form panels are interconnected by a plurality of jointing pieces passing through the corresponding cavities in the steel plates; the transverse jointing pieces are interconnected by transverse connecting locks and by vertical connecting locks; and pre-drilled holes are formed at the backside of the steel plates.

19 Claims, 5 Drawing Sheets

ASSEMBLAGE CONCRETE SYSTEM AND METHODS OF CONSTRUCTING THEREOF

BACKGROUND OF THE INVENTION

1. Field of the Invention

This invention relates to concrete buildings and methods for constructing thereof, and more particularly to thermally-insulated concrete building wall moduli and methods for constructing thereof.

2. Description of the Related Art

Higher energy costs and worries about the environmental impact of global warming have lead to an overall increase in construction of energy-saving buildings, and specifically to the development of various energy-saving technologies for building construction, with the emphasis on the improvement of the thermal insulating properties of walls, roofs, doors and windows.

Conventional buildings are constructed using the structure-first-thermal-insulation-second-and-decoration-last approach, wherein external and internal multi-layered insulations are often employed. However, separate steps for producing and installing the insulation layer unnecessarily prolong the construction process resulting in an increase of construction costs and a decrease in the reliability of buildings.

To solve these shortcomings, Chinese Pat. No. CN1570304 discloses a thermally-insulated concrete system, wherein a thermally-insulating material is provided in the form of inner and outer insulation panels formed inseparably from and simultaneously with a concrete wall. In this manner, the separate construction and affixture of the thermal insulation layer is avoided, and the cost of construction is largely reduced.

However, despite its advantages, this improved construction system suffers from inefficiency problems because the concrete is poured sectionally and in multiple phases during the construction process. Accordingly, much opportunity for improvement remains so as to shorten the construction period, improve the strength and stability of the construction structure, and accommodate customizations.

SUMMARY OF THE INVENTION

In view of the above-described opportunities, it is one objective of the present invention to provide a one-piece monolithic moduli of composite, thermally-insulated concrete walls and a method of constructing the same with the purpose of solving the technical problems involved in rapid construction of energy-saving buildings in factory settings and improving further the strength and stability of one-piece monolithic thermally-insulated concrete building wall moduli.

In accordance with one embodiment of the present invention, there is provided a one-piece layered monolithic modulus of composite thermally-insulated concrete walls comprising a foundation; a concrete wall; a plurality of reinforcing steel plates; a pair of wall form panels; a slab; and optionally a plurality of slab-supporting bars; wherein the wall form panels having a plurality of steel plates distributed in uniform spacing and embedded vertically therein are made of polystyrene foam plastic; a plurality of teeth are vertically arranged on the two peripheral edges of the steel plate; a cavity is formed on each tooth; the teeth and the cavities protrude out of the inner surface of said wall form panels; a pair of channel-shaped steels with slots facing upwards are affixed horizontally on the foundation; the bottom surfaces of the wall form panels are affixed respectively into the slots of the channel-shaped steels; a plurality of welded steel fabrics are embedded in the spaces between the wall form panels; at least two wall form panels are interconnected by a plurality of jointing pieces passing through the corresponding cavities in the steel plates; the transverse jointing pieces are interconnected by transverse connecting locks and by vertical connecting locks; and pre-drilled holes are formed at the backside of the steel plates.

In certain embodiments of the present invention, the one-piece layered monolithic modulus of composite thermally-insulated concrete walls comprises one or more of the following layers attached to the wall form panels: a layer of self-adhesive fiber cloth; a layer of cement mortar brushed or sprayed onto the outer surface of the self-adhesive fiber cloth; a layer of metal mesh fastened by a plurality of rivets at the pre-drilled holes of the steel plates; and a layer of cement mortar and a layer of outer coating brushed or sprayed onto the outer surface of the metal mesh.

In certain embodiments of the present invention a plurality of slab-supporting bars are vertically disposed at the periphery of the wall form panels; a slab panel mould is disposed horizontally above the slab-supporting bars; the slab panel mould is constructed by knitting side-by-side pieces of slab form panels together to form a slab floor; each slab form panel has a convex cross section and is made of polystyrene foam plastic; a plurality of concave and convex grooves are formed at the end faces and shoulders of each convex slab form panel; a pair of passages arranged in parallel are disposed in the middle section of each convex slab form panel; a pair of double-flanged steel plates are embedded along the common longitudinal direction of the underside of the convex slab form panel; the openings of the two double-flanged steel plates oppose each other; grooves are framed between the convex ridges of each of the two convex slab form panels with ribbed beam steels arranged therein and welded slab steel fabrics disposed thereon; the concrete is poured layer-by-layer and monolithically into the spaces between the wall form panels, above the slab panel mould, and the regions proximate thereto.

In certain embodiments of the present invention, a construction method of a one-piece layered monolithic modulus of composite thermally-insulated concrete walls comprises the steps of:

(1) affixing horizontally a pair of channel-shaped steels with slots facing upwards to the top of a foundation, whereby defining the outer edge of the concrete to be poured, after the foundation is constructed and the welded steel fabrics are fabricated;

(2) affixing a pair of wall form panels into the corresponding slots of the channel-shaped steels, wherein the wall form panels are made of polystyrene foam plastic; a plurality of steel plates are distributed in uniform spacing and embedded vertically in the wall form panels; a plurality of teeth are vertically disposed on the two peripheral edges of the steel plates; a cavity is formed on each tooth; and the teeth and the cavities protrude out of the inner surface of the wall form panels;

(3) passing a plurality of jointing pieces through a plurality of cavities disposed in the steel plates mounted on the wall form panels, and fastening the jointing pieces to one another by transverse and vertical connecting locks;

(4) affixing a self-adhesive fiber cloth onto the outer surface of the wall form panels; and plugging with plastic plugs the pre-drilled holes disposed on the steel plates attached to the wall form panels;

(5) brushing or spraying a first layer of cement mortar onto the outer surface of the fiber cloth;

(6) removing the plastic plugs; and fastening a metal mesh to the steel plates at the position of pre-drilled holes by a plurality of rivets;

(7) brushing or spraying a second layer of cement mortar onto the outer surface of the metal mesh, and constructing a layer of outer coating thereon;

(8) erecting a plurality of slab-supporting bars, and placing a slab panel mould thereon;

(9) installing ribbed beam steels into the grooves of the slab panel mould, and installing the welded slab steel fabric;

(10) affixing a single-sided wall form panel onto the outer wall form panel;

(11) optionally installing one or more tubular casings at the positions where the wall or the slab is being penetrated; and

(12) pouring concrete to form the modulus of composite thermally-insulated concrete walls as a single piece.

In certain embodiments of the present invention, the steel plate(s) have a "Π"-shaped or a "U"-shaped cross section.

In certain embodiments of the present invention, the jointing piece(s) are of the "]"-shape having a curved hook at each of its ends.

In certain embodiments of the present invention, the transverse connecting lock is rod-like shaped having two grooves at the transverse position corresponding to the two jointing pieces to be joined In certain embodiments of the present invention, the vertical connecting lock is rod-like shaped having a plurality of grooves at the vertical position corresponding to the jointing pieces to be joined.

In certain embodiments of the present invention, the edges of the wall form panel and the slab form panel are butting edges, concave jointing edges, or convex jointing edges.

In certain embodiments of the present invention, a decorative outer layer is coated on the outer surface of the reinforcing layer of the wall form panel.

In certain embodiments of the present invention, the channel-shaped steel fixed on top of the foundation is a C-shaped steel or a channel steel.

In certain embodiments of the present invention, the cement mortar is a polymer cement mortar or a fiber cement mortar.

In certain embodiments of the present invention, the layered monolithic modulus of composite thermally-insulated concrete walls and the method of constructing thereof in accordance with the present invention provide the following advantages:

(1) the prefabricated wall form panel is suitable for use with various concrete-poured walls, the assembly is easy and fast, the control of dimensions is accurate, and the integral stability is high;

(2) the slab panel mould is easy to assemble, and the arrangement of the complex slab and ribbed beam moulds can be completed conveniently;

(3) the prefabricated wall form panel is associated with the slab panel mould to form the layered monolithic modulus of composite thermally-insulated concrete walls, which is beneficial to prevent cracking and resist structural damage from earthquakes;

(4) the design is integrated and the production and assembly is modularized. The construction quality and construction periods are controlled precisely, the factory construction of concrete buildings is realized, and the on-site construction does not require wet conditions;

(5) the wall and the slab form panels will remain in place to form a composite wall and slab modulus having thermal insulating and sound insulating capabilities after the concrete is poured; this offers the features of conformity to the requirements of energy saving buildings, good thermal insulating properties and sound insulating performance, high percentage of usable dwelling area, strong anti-quake resistance of the structure, and an efficient construction process.

(6) the on-site construction speed with prefabricated form panels is faster than that with conventional steel form panels; the form panels are not needed to be removed after the construction process is completed;

(7) the modulus allows for a convenient installing of various piping and electric lines in the walls and slabs;

(8) the wall form panels are interconnected by jointing pieces, which are then fixed by transverse and vertical connecting locks, the steel plates of the integral structure are interconnected with each other and the concrete is poured monolithically, which is beneficial to increase the strength and stability of the structure;

(9) the high number of layers attached consecutively to the outer surface of the wall form panels allows for a high resistance to cracking; and since it is not necessary to construct these layers until the main structure is completed the construction period is shortened.

The moduli according to the present invention are used, in certain embodiments, in the construction of high-rise buildings and are well-suited for such constructions.

BRIEF DESCRIPTION OF THE DRAWINGS

Preferred embodiments of the present invention will hereinafter be described in more detail with reference to the accompanying drawings, in which.

Figure 1:
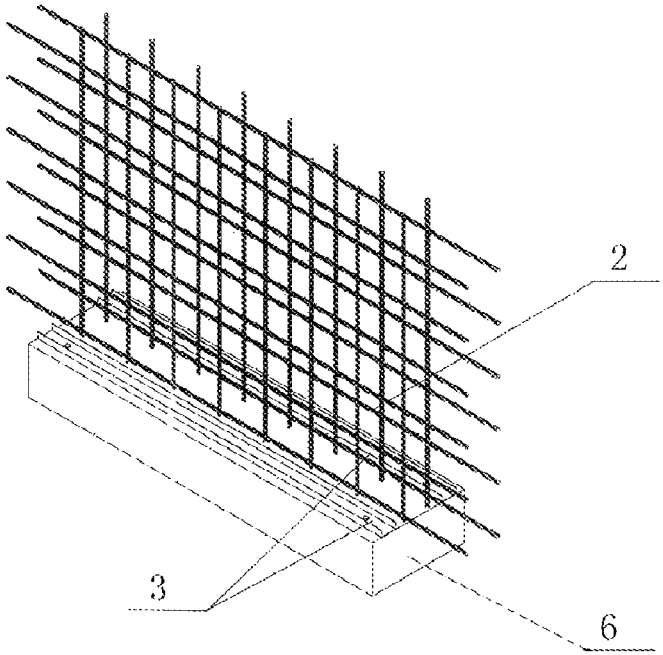
FIG. 1 illustrates an assembly of the channel-shaped steels and the welded steel fabric.

The reference numbers of the various parts shown in the drawings are listed below, in which: wall form panel corresponds to the number 1; welded steel fabric—2; channel-shaped steel—3; steel plate—4; jointing piece—5; foundation—6; tooth—7; cavity —8; transverse connecting lock—

9; vertical connecting lock—10; pre-drilled hole—12; self-adhesive fiber cloth—13; first layer of cement mortar—14; metal mesh—15; second layer of cement mortar—16; outer coating—17, 17'; slab-supporting bar—18; slab panel mould—19; ribbed beam steel—20; welded slab steel fabric—21; poured concrete—22; plastic plug—23; rivet—24; and single-sided wall form panel—25.

DETAILED DESCRIPTION OF THE INVENTION

As shown in FIGS. 1-9, a one-piece monolithic modulus of composite thermally-insulated concrete walls in accordance with the present invention comprises a foundation 6; a concrete wall; a plurality of reinforcing steel plates 4; a pair of wall form panels 1; one or more slabs 19; and optionally a plurality of slab-supporting bars 18; wherein in certain embodiments the wall form panel 1 is made of polystyrene foam plastic having a density of about 30 kg/m$^3$, a plurality of steel plates 4 are distributed in uniform spacing and embedded vertically within the wall form panels, a plurality of teeth 7 are vertically arranged on the two peripheral edges of the steel plate 4, a cavity 8 is formed on each tooth, and the teeth and the cavities protrude out of the inner surface of the wall form panel 1.

Figure 2:
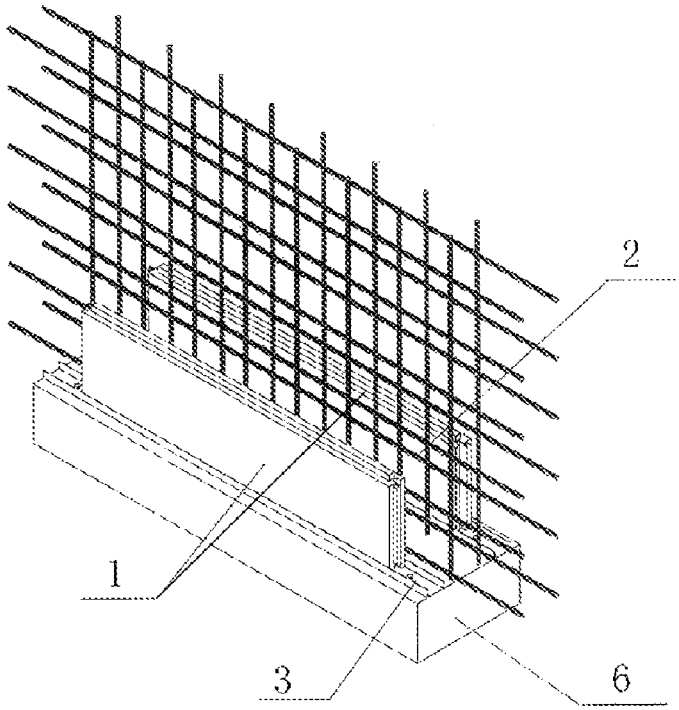
FIG. 2 illustrates an assembly of wall form panels.
Figure 3:
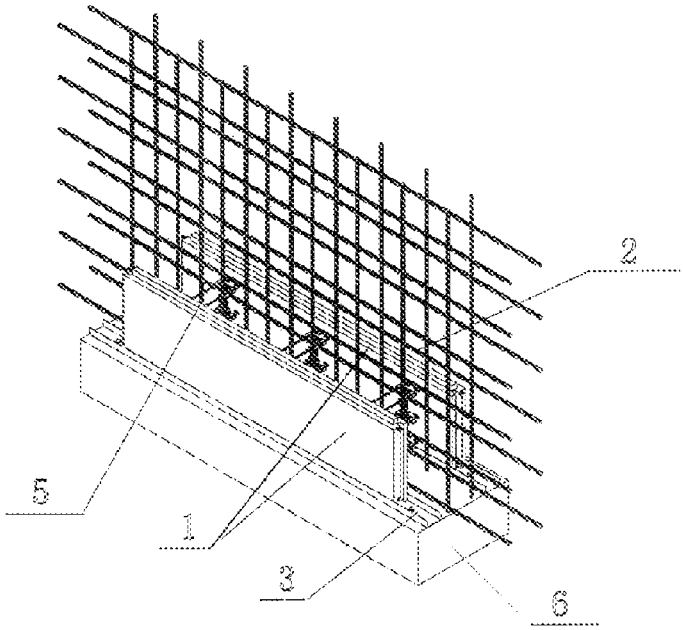
FIG. 3 illustrates the jointing of the wall form panels to one another.

With reference to FIGS. 1-3, a pair of channel-shaped steels 3 (also referred to hereinbelow as "C-shaped steels" or "channel steels") with slots facing upwards are fixed horizontally on the foundation 6. The bottom surfaces of the wall form panels 1 are fixed respectively into the slots of the channel-shaped steels 1. A plurality of welded steel fabrics 2 are embedded in the space between the wall form panels. Separate wall form panels 1 are interconnected with each other by a plurality of jointing pieces 5 passing through the corresponding cavities 8 disposed on the teeth 7 of the steel plates 4. Pairs of transverse jointing pieces 5 (i.e., two closest jointing pieces having the same horizontal height, e.g., the two top joining pieces in FIG. 4) are fixed by transverse connecting locks 9, and each column of jointing pieces are additionally longitudinally fixed by vertical connecting locks 10. Pre-drilled holes 12 are formed at the outside of the steel plates 4. The steel plates 4 have a "Π"-shaped or "U"-shaped cross section. Said jointing pieces 5 are of "]"-shape having a curved hook at each of the both ends. Said transverse connecting lock 9 is rod-like shaped having two grooves at the transverse position corresponding to the two jointing pieces to be joined. The vertical connecting lock 10 is rod-like shaped having a plurality of grooves at the vertical position corresponding to the jointing pieces to be joined.

Figure 5:
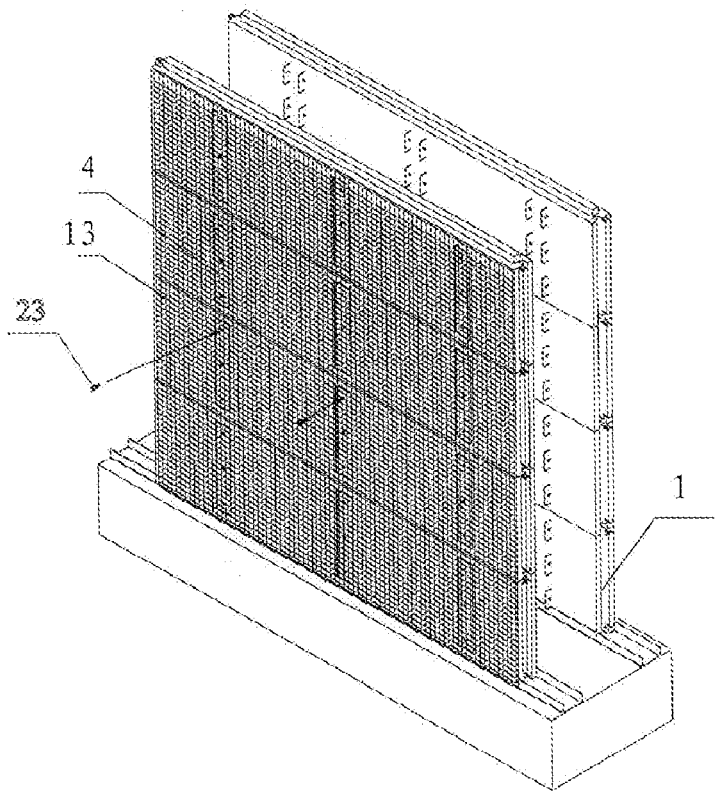
FIG. 5 illustrates an assembly of self-adhesive fiber cloth on the outer surface of the wall form panels.
Figure 6:
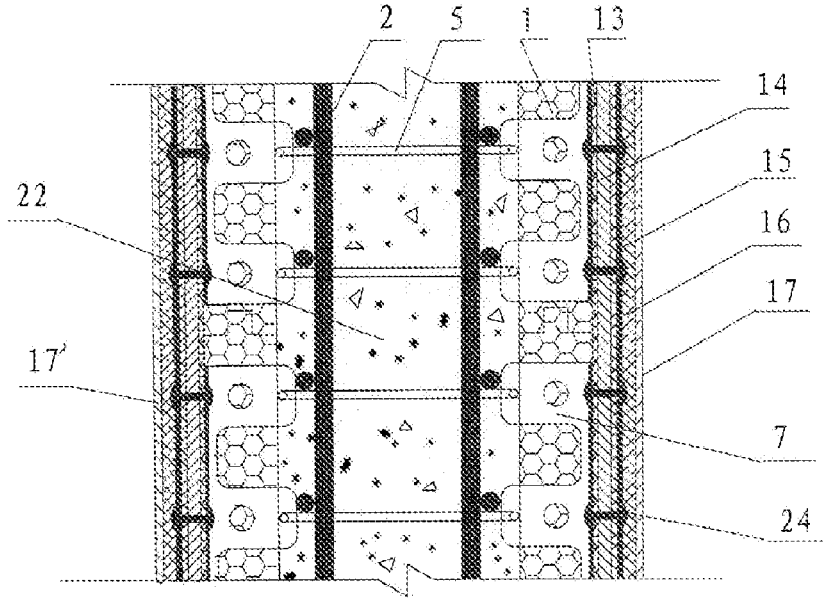
FIG. 6 is a cross-sectional diagram illustrating a part of the modulus of composite thermally-insulated concrete walls in accordance with the present invention.

With reference to FIGS. 5 and 6, the following reinforcing layers are attached to the outer surface of the wall form panels: a layer of self-adhesive fiber cloth 13; a first layer of cement mortar 14 brushed or sprayed onto the outer surface of the self-adhesive fiber cloth; a layer of metal mesh 15 fastened by a plurality of rivets 24 at the pre-drilled holes of the steel plates; and a second layer of cement mortar 16 brushed or sprayed onto the outer surface of the metal mesh. The cement mortar is in certain embodiments a polymer cement mortar or a fiber cement mortar. A layer of outer coating 17 is attached to the outer surface of the reinforcing layers of the wall form panel.

Figure 7:
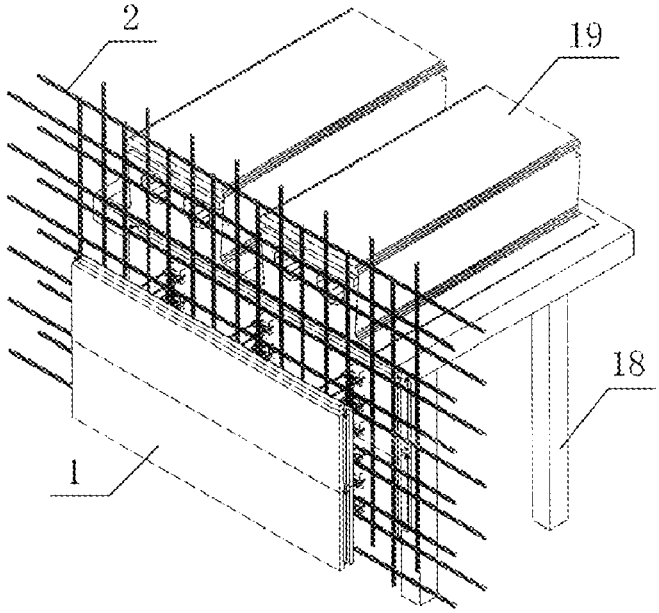
FIG. 7 illustrates an assembly of the slab panel mould supported by the slab-supporting bars.
Figure 8:
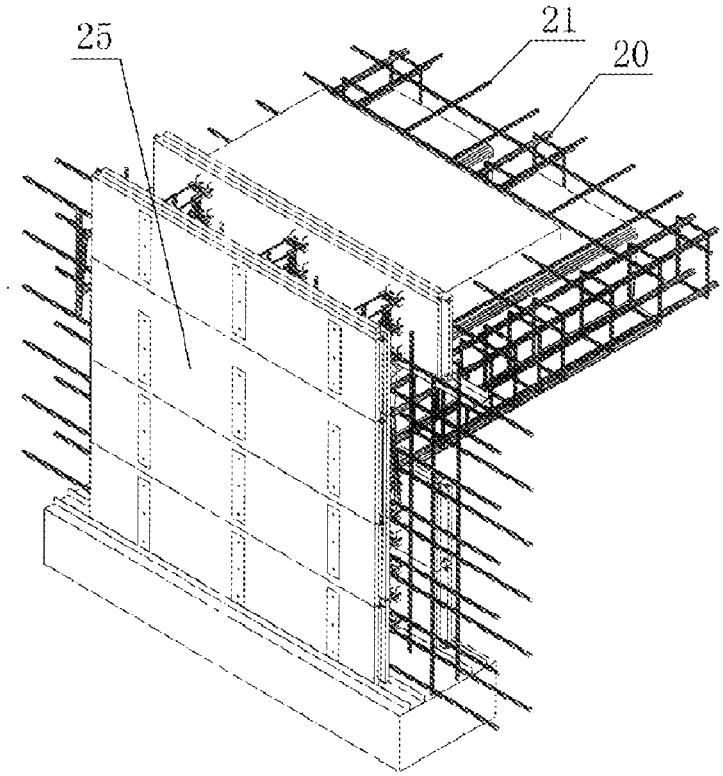
FIG. 8 illustrates a slab armouring assembly and a single-sided form panel attached to the wall form panel.
Figure 9:
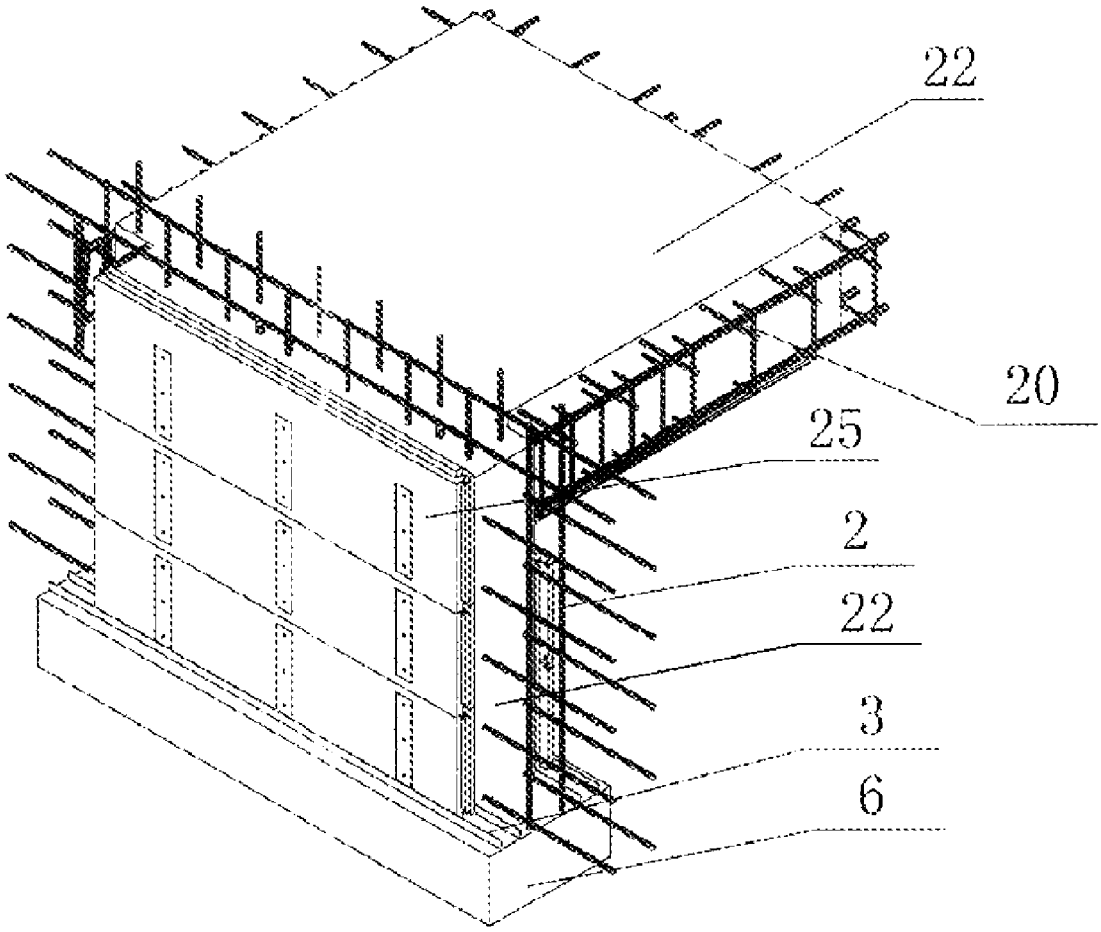
FIG. 9 illustrates one embodiment of the modulus of composite thermally-insulated concrete walls in accordance with the present invention.

With reference to FIGS. 7-9, a plurality of slab-supporting bars 18 is vertically disposed at the periphery of the wall form panels, a slab panel mould 19 is laid horizontally above the slab-supporting bars. The slab panel mould is constructed by knitting side-by-side pieces of slab form panels together to form a slab floor. The concrete is then layer-by-layer monolithically poured into the spaces between the wall form panels 1, above the slab panel mould, and the regions enveloped thereby.

Figure 4:
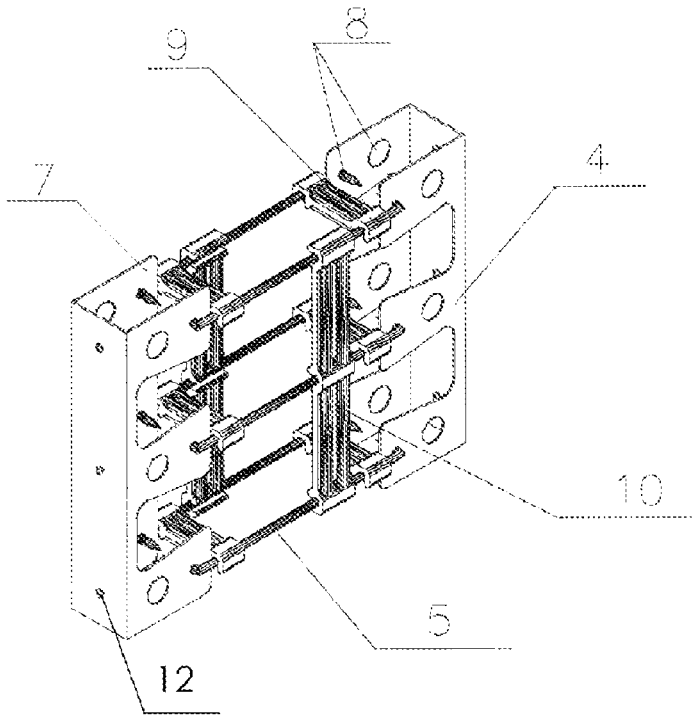
FIG. 4 illustrates two steel plates joined by jointing pieces interlocked by transverse connecting locks and vertical connecting locks.

In certain embodiments of the invention, a method for constructing a modulus of composite thermally-insulated concrete walls comprises the following steps:

(1) after the foundation 6 is constructed and the welded steel fabrics 2 are fabricated, horizontally affixing a pair of channel-shaped steels 3 with slots facing up by anchor bolts to the top of the foundation, thereby defining the outer edge of the concrete to be poured (FIG. 1);

(2) affixing a pair of wall form panels 1 to the corresponding slots of the channel-shaped steels 3, wherein the wall form panels 1 are made of polystyrene foam plastic; a plurality of steel plates 4 are distributed in uniform spacing and embedded vertically in the wall form panels; a plurality of teeth 7 are vertically disposed on the two peripheral edges of the steel plates 4; a cavity 8 is formed on each tooth; and the teeth and cavities are protruding out of the inner surface of the wall form panels 1 (FIG. 2);

(3) passing a plurality of jointing pieces 5 through a plurality of cavities 8 disposed in the steel plates 4 mounted on the wall form panels 1, and fastening the jointing pieces to one another by transverse connecting locks 9 and vertical connecting locks 10 (FIG. 3-4);

(4) affixing a self-adhesive fiber cloth 13 onto the outer surface of the wall form panels 1; and plugging with plastic plugs 23 the pre-drilled holes 12 disposed on the steel plates 4 attached to the wall form panels 1 (FIG. 5);

(5) brushing or spraying a first layer of cement mortar 14 onto the outer surface of the fiber cloth 13 (FIG. 6);

(6) removing the plastic plugs 23; and fastening a metal mesh 15 to the steel plates 4 at the position of pre-drilled holes by a plurality of rivets 24;

(7) brushing or spraying a second layer of cement mortar 16 onto the outer surface of the metal mesh 15, and constructing a layer of outer coating 17, 17' thereon (FIG. 6);

(8) erecting a plurality of slab-supporting bars 18, and placing a slab panel mould 19 thereon (FIG. 7);

(9) installing ribbed beam steels 20 into the grooves of the slab panel mould, and installing the welded slab steel fabric 21 (FIG. 8);

(10) affixing a single-sided wall form panel 25 onto the outer wall form panel 1 (FIG. 8);

(11) optionally installing one or more tubular casings at positions where the wall or the slab is being penetrated; and

(12) pouring concrete to complete the modulus of composite thermally-insulated concrete walls as a single piece (FIG. 9).

What is claimed is:

1. A modulus of composite thermally-insulated concrete walls comprising:

a foundation;

a pair of wall form panels each having an inner surface and an outer surface;

a plurality of steel plates having peripheral edges;

one or more slabs; and optionally a plurality of slab-supporting bars, wherein at least one said wall form panel is made of polystyrene foam;

a plurality of said steel plates is distributed in uniform spacing and embedded vertically within said wall form panels;

a plurality of teeth are vertically arranged on the peripheral edges of said steel plates;

a plurality of cavities are formed, at least one cavity on each said tooth;

said teeth protrude out of the inner surface of said wall form panels;

a pair of channel-shaped steels with slots facing upwards are fixed horizontally on said foundation;

each wall form panel has a bottom surface;

said bottom surfaces are fixed respectively into the slots of said channel-shaped steels;

a space is formed between said wall form panels;

a welded steel fabric is embedded in said spaces between said wall form panels; and said wall form panels are interconnected by a plurality of jointing pieces passing through said cavities, said jointing pieces being connected by transverse connecting locks and by vertical connecting locks.

2. The modulus of claim 1 further comprising one or more layers attached to the outer surface of said wall form panels, said layers being selected from a layer of self-adhesive fiber cloth having an outer surface;

a layer of cement mortar brushed or sprayed onto the outer surface of said self-adhesive fiber cloth, a layer of metal mesh fastened by a plurality of rivets at pre-drilled holes disposed of said steel plates; and a layer of cement mortar and a layer of outer coating brushed or sprayed onto the outer surface of said metal mesh.

3. The modulus of claim 2, wherein a decorative outer layer is coated on the outer surface of the reinforcing layer of said wall form panel.

4. The modulus of claim 2, wherein said cement mortar is polymer cement mortar or fiber cement mortar.

5. The modulus of claim 1, wherein said steel plates have a "Π"-shaped or "U"-shaped cross-section.

6. The modulus of claim 1, wherein said jointing piece is of "]"-shape, having a curved hook at each of its two ends.

7. The modulus of claim 1, wherein said transverse connecting lock is rod-shaped having two grooves corresponding to the two jointing pieces to be joined.

8. The modulus of claim 1, wherein said vertical connecting lock is rod-like shaped having a plurality of grooves corresponding to the jointing pieces to be joined.

9. The modulus of claim 1, wherein said channel-shaped steel disposed on top of said foundation is a C-shaped steel.

10. A modulus of composite thermally-insulated concrete walls comprising:

a foundation;

a pair of wall form panels each having an inner surface and an outer surface;

a plurality of steel plates having peripheral edges;

one or more slabs; and optionally a plurality of slab-supporting bars, wherein at least one said wall form panel is made of polystyrene foam;

a plurality of said steel plates is distributed in uniform spacing and embedded vertically within said wall form panels;

a plurality of teeth are vertically arranged on the peripheral edges of said steel plates;

a plurality of cavities are formed, at least one cavity on each said tooth;

a plurality of slab-supporting bars are vertically located at the periphery of said wall form panels;

a slab panel mould is disposed horizontally above said slab-supporting bars;

said slab panel mould is constructed by knitting side-by-side pieces of convex and concave slab form panels together to form a slab floor;

a plurality of grooves are formed at the end faces and shoulders of each said convex slab form panel;

a pair of passages arranged in parallel are disposed at the middle portion of each convex slab form panel;

and concrete is disposed in the space between the wall form panels, and above the slab panel mould.

11. The modulus of claim 10, wherein the edges of said wall form panel and said convex and concave slab form panels are butting edges or concave and convex jointing edges.

12. A method for constructing a modulus of composite thermally-insulated concrete walls comprising:

(1) affixing horizontally to the top of a foundation a pair of channel-shaped steels with slots facing upwards;

(2) affixing a pair of wall form panels into the corresponding slots of the channel-shaped steels, wherein the wall form panels are made of polystyrene foam; a plurality of steel plates are distributed in uniform spacing and embedded vertically in the wall form panels; a plurality of teeth are vertically disposed on the two peripheral edges of the steel plates; a plurality of cavities, at least one cavity formed on each tooth; and the teeth and the cavities protrude out of the inner surface of the wall form panels;

(3) passing a plurality of jointing pieces through said plurality of cavities disposed in said steel plates, and fastening the jointing pieces to one another by transverse and vertical connecting locks;

(4) affixing a self-adhesive fiber cloth onto the outer surface of the wall form panels; and plugging with plastic plugs the pre-drilled holes disposed on the steel plates attached to the wall form panels;

(5) brushing or spraying a first layer of cement mortar onto the outer surface of the fiber cloth;

(6) removing the plastic plugs, and fastening a metal mesh to the steel plates at the position of pre-drilled holes by a plurality of rivets; and (7) brushing or spraying a second layer of cement mortar onto the outer surface of the metal mesh, and constructing a layer of outer coating thereon.

13. A method of claim 12 comprising further (8) erecting a plurality of slab-supporting bars, and placing a slab panel mould thereon;

(9) installing ribbed beam steels into the grooves of the slab panel mould, and installing a welded slab steel fabric;

(10) affixing a single-sided wall form panel onto the outer wall form panel;

(11) optionally installing one or more tubular casings at the positions where the wall or the slab is being penetrated; and

(12) pouring concrete at least into the space defined by said well form panels.

14. The method of claim 13, wherein said steel plates have a "Π"-shaped or "U"-shaped cross-section.

15. The method of claim 13, wherein said jointing piece is of "]"-shape, having a curved hook at each of its two ends.

16. The method of claim 13, wherein said transverse connecting lock is rod like shaped rod-shaped having two grooves corresponding to the two jointing pieces to be joined.

17. The method of claim 13, wherein said vertical connecting lock is rod-like shaped having a plurality of grooves corresponding to the jointing pieces to be joined.

18. The method of claim 13, wherein a decorative outer layer is coated on the outer surface of the reinforcing layer of said wall form panel.

19. The method of claim 13, wherein said cement mortar is polymer cement mortar or fiber cement mortar.

* * * * *